United States Patent [19]

Vigano'

[11] 4,288,067

[45] Sep. 8, 1981

[54] MACHINE FOR FOLDING SHEETS

[76] Inventor: Vittorio Vigano', Via Delle Ginestre, 13, Zingonia, Province of Bergamo, Italy

[21] Appl. No.: 973,297

[22] Filed: Dec. 26, 1978

[30] Foreign Application Priority Data

Jan. 4, 1978 [IT] Italy ..... 19019 A/78

[51] Int. Cl.[3] ..... B65H 45/18

[52] U.S. Cl. ..... 493/420; 29/116 R; 29/121.1; 29/130; 493/426; 493/428

[58] Field of Search ..... 270/61 R, 80, 83, 67; 29/121.1-121.8, 125, 130, 116 R

[56] References Cited

U.S. PATENT DOCUMENTS

| | | | |
|---|---|---|---|
| 1,830,439 | 11/1931 | Mogaard | 70/61 R |
| 1,915,128 | 6/1933 | Keltie | 29/121.1 |
| 2,514,737 | 7/1950 | Anderson | 270/80 |
| 2,900,185 | 8/1959 | Petre | 270/80 |
| 3,266,414 | 8/1966 | Wahlstrom | 29/116 R |
| 3,349,462 | 10/1967 | Mott | 29/116 R |
| 3,447,600 | 6/1969 | Greene | 29/130 |
| 3,721,188 | 3/1973 | Jacobsen | 29/116 R |
| 3,748,711 | 7/1973 | Smith | 29/116 R |
| 3,796,423 | 3/1974 | Shuster | 270/83 |

*Primary Examiner*—Edgar S. Burr
*Assistant Examiner*—A. Heinz
*Attorney, Agent, or Firm*—Guido Modiano; Albert Josif

[57] ABSTRACT

A machine for folding sheet material comprises a plurality of rollers opposedly arranged in pairs and engaged at the ends with a stationary frame and biased towards each other by pushers. Each roller has a surface provided with resilient lugs and intervening smooth surfaces. Owing to the resilient lugs the rollers are forced to move away from each other, as the sheets move past, only to a limited extent thereby accommodating any uneveness in the sheets.

4 Claims, 4 Drawing Figures

MACHINE FOR FOLDING SHEETS

BACKGROUND OF THE INVENTION

This invention relates to an improved machine for folding sheets of various sizes and materials, such as the paper sheets that make up a book.

As is well known, the several processing steps which result in the formation of a book, booklet, or the like, include folding of the previously printed sheets in two overlapping flaps over each page, such as to define two or more page sheets. This folding operation is advantageously carried out on an automatic machine, of a type well known in the art, which comprises means adapted for folding the sheets in flaps and effective, in actual practice, to push the same along shaped paths such as to cause the sheets to fold over themselves, as well as rollers which act on the sheets already folded into flaps to squeeze them such as to create a neat and permanent crease or fold line.

These rollers are a source of serious technical problems in the construction of said machines for sheet folding, because the requisites imposed on them are both numerous and fundamental. In fact, they are required to be of generous dimensions, in the longitudinal direction, such as to allow the passage therebetween of sheets which may be very large; they must be capable of withstanding considerable pressure stress without flexing; they have to be manufactured to very close tolerance limits along their diametrical dimension, and to a virtually perfect roundness, as otherwise both the pressure applied and the tangential velocity would vary locally, and the sheets would be entrained in an uneven manner; and finally, they are to be so installed in the machine as to hold the pressure exerted by them at a strictly predetermined level in accordance with the type of sheets being processed, and such as to be easily disassembled and reassembled for servicing purposes.

Currently, these requirements are met by fabricating such rollers of solid steel, surface ground.

Furthermore, said rollers are manufactured with integral end hubs intended for pivotal insertion in the stationary frame of the machine. Provision is also made for at least one roller in a pair of opposed rollers to be detachable, or removable, from the other; in other terms, the hubs of one roller are associated with grooves or guiding members which allow for a clearly defined movement of the rollers away from each other against the bias of specially provided pusher members, usually calibrated springs.

This technique, in addition to being expensive, owing to the need for precision grinding rollers of considerable length, also originates serious problems of dynamic balance of the rollers during the machining thereof. In fact, the rollers are rotated about their own axes at a high angular velocity, which induces in the same, due to the presence of unavoidable uneven areas in the distribution of weights, oscillatory and whip phenomena of a more or less enhanced character, owing to which the rollers undergo alteration of their strictly linear pattern between their ends, and flex. It is evident that such dynamic stability deviations can be very serious, in that they cause uneven entrainment of the sheets.

The cited phenomena are further enhanced, or at least undiminished, by the simple roller supports, said rollers being inserted with their hubs free and slidable within the frame. In fact, with the hubs being simply supported for rotation, maximum freedom is conceded to the development of such dynamic oscillatory phenomena and the rollers are allowed to flex in all directions at their middle portion, without said hubs opposing any resistance thereto.

Such drawbacks are further aggravated by the rollers being not only rotated at a very high speed about their axes, but also flexure stressed by the sheets being inserted therebetween under high pressure force.

The above not only applies to the stationary rollers, but also to the raisable ones. In fact, the sheets, as they enter the nip between two rollers, tend to raise the movable roller in a random, within limits, direction, usually not exactly coincident with the direction of upward movement provided for the roller. That is, the movable roller is usually raised somewhat obliquely to the direction of the impact force generated by the admission of a folded sheet, thereby it is also subjected to efforts and flexure with the end supports.

Lastly, it should be noted that the calibrated springs, as employed of usual, in mutually biasing the rollers against each other, slightly yield in time, often to an uneven extent, thus permitting irregular oscillation of the roller ends, instead of, as required, just equal movements of the rollers to and from each other.

The Applicant has found that such drawbacks cannot be even alleviated by coating the rollers with an elastic material capable of accommodating thickness irregularities in the sheets, or the sheet insertion and extraction operations. It could be ascertained, in fact, that this remedy is unacceptable owing both to the material wearing out very rapidly and to its enhancing the irregularities and dynamic vibrations of the rollers due to its elastic action.

The one improvement achieved in relation to the above has been the coating of the rollers either completely, or partially, or along helical paths, with hard rubber, which wears slowly and has no elastic effects. However, this only provided improvement as relates to the frictional action applied by the rollers to the paper sheets, since the harder the rubber is, the less capable is this of absorbing the sheet impact forces, and the more elastic is the rubber, within the limitations imposed by the wear requirements, the greater are the periodic oscillations and prolonged vibrations between the rollers.

Thus, the problems connected with the structure and support of said rollers in the machine are still without a satisfactory solution.

SUMMARY OF THE INVENTION

It is an object of this invention to obviate the drawbacks mentioned above and to solve the technical problem of how to design and mount in a sheet folding machine, said pivoting rollers such as to prevent them, when rotated at a high speed about their axes and caused to clamp the sheets therebetween, from developing oscillations or deflections causing uneven entrainment of the sheets.

This object is substantially achieved by an improved machine for folding sheet material, according to this invention, comprising a plurality of rollers opposedly arranged in pairs and engaged at the ends thereof with a stationary frame and biased towards each other by pressure members, characterized in that said rollers have an outer surface provided with flexible lugs.

BRIEF DESCRIPTION OF THE DRAWING

Further features and advantages will become apparent from the following detailed description of a preferred but not exclusive embodiment of the invention, illustrated by way of example and not of limitation in the accompanying drawing where.

DESCRIPTION OF THE PREFERRED EMBODIMENT

Figure 1:
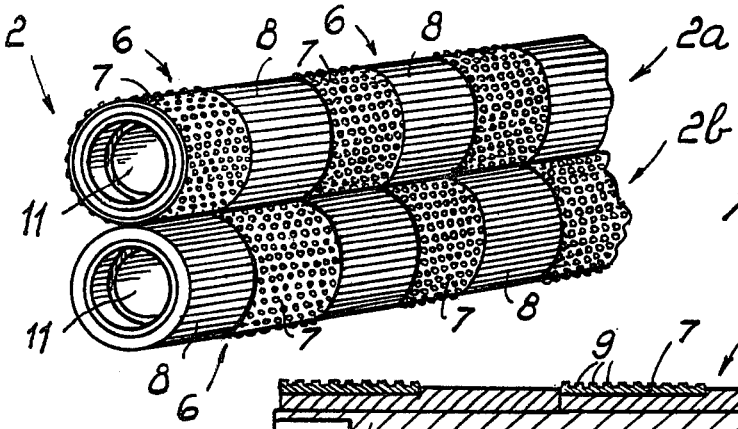
FIG. 1 shows two opposedly located rollers according to this invention.

The instant sheet folding machine comprises, in a manner known per se and not shown in the drawing, means adapted for folding the sheets in flaps, based upon the use of confining paths which force the sheets to fold or double upon themselves; rotary or pivoting rollers which are arranged in contiguous and opposed sets, wherebetween the folded sheets are caused to pass for pressing purposes; and drive means for driving said rollers rotatingly, e.g. an electric motor transmitting its motion to all of the rollers through a gear train or drive belts.

With reference to the cited drawing figures, the machine according to the invention comprises a stationary frame 1, whereby the ends of a first roller 2*a* and second roller 2*b*, opposedly located to the first and parallel thereto, are supported rotatably. Both rollers, 2*a* and 2*b*, are supported by means of gudgeons or pins, respectively a first pin 4 and second pin 5. The first roller 2*a* is made movable away from the second roller 2*b*, as will be explained hereinafter, whereas the roller 2*b* has a fixedly located axis. Moreover, the first roller 2*a* is associated with pushers or pressure members 3 which are effective to resist separation from the second roller 2*b* and include, advantageously, pneumatic or air-operated cylinders 18 swivel connected at the top, at 17, to lugs 1*a* of the frame 1 and extending each in a stem 19 and collar 10 encircling the first pin 4 of the first roller 2*a*.

The pins 4 and 5 are advantageously stationary relative to rotation in the frame 1, and rotatably support to the rollers 2*a* and 2*b* through interposed bearings 12 located in seats formed in the roller ends. In particular, the bearings 12 are thrust bearings, since it is contemplated that the support pins 4 and 5 be arranged within the stationary frame 1 such as to keep the respective rollers biased in the axial direction. Still more particularly, the pins 4 and 5 compress the respective rollers at their ends. Such compression is obtained by the use of compression springs, e.g. as shown for the top roller 2*a*, or by inelastic engagement means, as shown for the bottom roller 2*b*. In fact, the first pin 4, which is formed at its outer surface with a first smooth portion 4*a* and a second threaded portion 4*b*, is threaded into the collar 10, and secured therein with a retainer 14, while the collar 10 is in turn biased by two cup springs 13 bearing on the frame 1 and acting towards the first roller 2*a*.

The second pin 5 is threaded full length and screw engaged with the frame 1, and secured with another retainer 21. It is contemplated that the tightening be effected securely, by inserting a suitable tool in a recess 15, such as to pressure force the second roller 2*b*.

Figure 4:
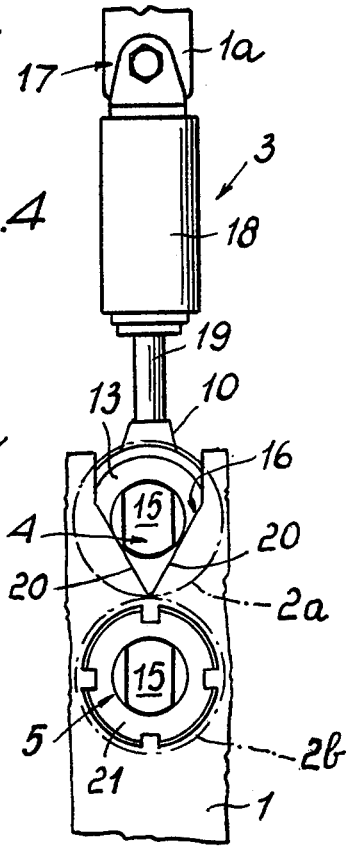
FIG. 4 is a view taken perpendicularly to the preceding one, showing the same components as FIG. 3, not in section.

FIG. 4 shows in particular how the first pin 4 has its unthreaded portion 4*a* inserted in a "V" notch 16 allowing for the pin itself, and accordingly the first roller 2*a*, a wide range of movements against the action of the pneumatic cylinder 18. The "V" notch 16 defines two inclined end surfaces 20, extending obliquely to each other and substantially symmetrical with respect to a plane including the axis of the second roller 2*b*, and the axis of the swivel connection 17.

According to the invention, the rollers 2 comprise an inner cylindrical core 11 in a single piece, and a plurality of sleeves 6 which are arranged and locked onto the core 11 at closely contiguous locations, such as to define with their outer surfaces the outer cylindrical surface of each roller 2. In particular, said outer surface of each roller 2 has areas whereon a coated portion or lining 7 is provided which is made of substantially hard and unelastic rubber or the like material, and areas defined by uncoated surface portions 8 of the sleeves 6.

These uncoated surface portions 8 are knurled lengthwise to the rollers 2. The coated portion 7 of hard rubber or the like material presents surface irregularities which form flexible lugs or bosses 9. These bosses have outer ends which project with respect to the uncoated portions 8 on the rollers 2, as clearly visible in the drawing.

Figure 2:
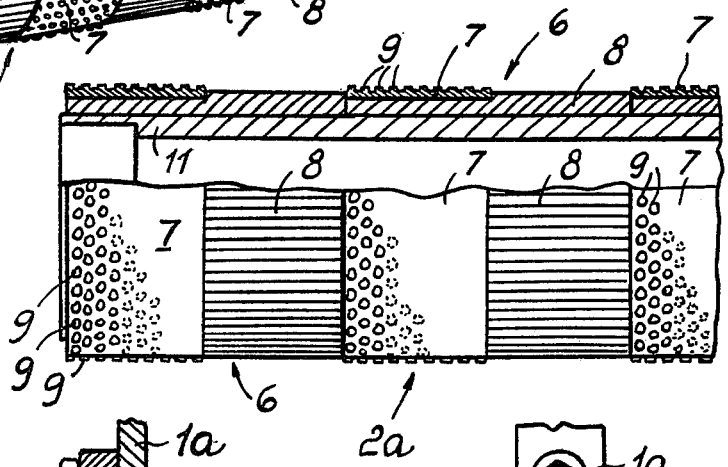
FIG. 2 shows, partly in elevation and partly in section, the structure of a roller as depicted in FIG. 1.
Figure 3:
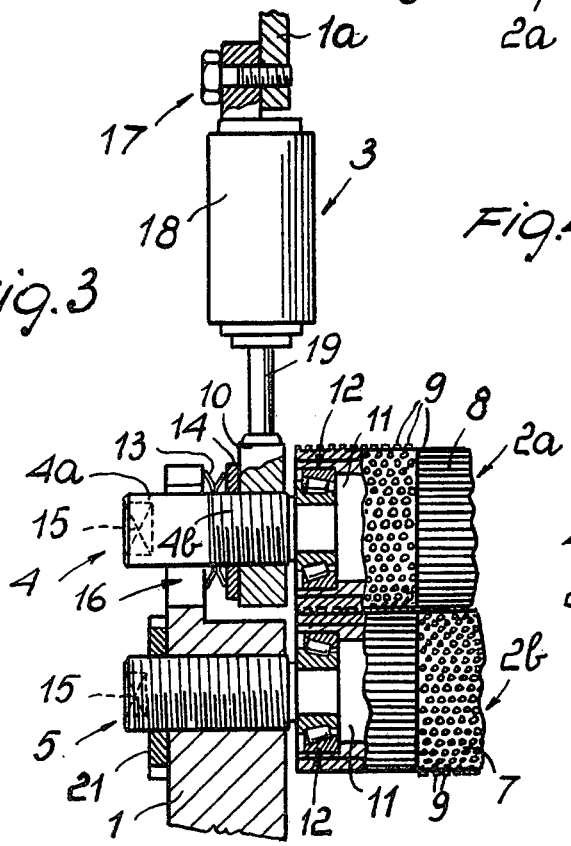
FIG. 3 is a partly sectional view of the ends of two opposed rollers, as depicted in FIG. 1, and of a portion of the machine frame and of the roller pressure members.

The sleeves 6 may be as numerous as desired and secured in any suitable manner, on condition that they are strictly balanced to the core 11 of the rollers, which is advantageously shown hollow in the drawing. Furthermore, each sleeve may have the coated portions 7 and the uncoated ones 8 arranged arbitrarily. Advantageously, however, as shown in FIG. 2, each sleeve 6 comprises one coated portion 7 and one uncoated portion 8 and the sleeves 6 are arranged such that these portions are alternated and the coated portions 7 define a series of rings parallel to one another and axially spaced apart by distances equivalent to their own lengths. In other words, the coated portions 7 and the uncoated portions 8 have equal axial lengths.

This advantageously permits the rollers to be opposingly arranged, as shown in FIG. 1, with the coated portions 7 of one roller axially offset with respect to the coated portions 7 of the other roller such that each coated portion 7 of one roller exactly faces a corresponding one of the uncoated surface portions 8 of the adjacent roller.

The improved machine according to this invention operates as follows.

In a manner known per se, the sheets are folded into flaps within the machine, and then directed to the nip between the rollers 2*a* and 2*b* for the pressing step. The rollers 2*a* and 2*b* are opposedly located to each other and carried by the pins 4 and 5.

The pins 4 and 5 are prevented from rotation, and are inserted directly into the frame 1.

Furthermore, the pins 4 and 5, either owing to the action of the springs 13 or of the forced screw engagement thereof, apply an axially directed compressive force to the rollers 2*a* and 2*b*, with the interposition of thrust bearings effective to permit both transmission of the compressive stress and the rotation of the rollers with respect to the pins. In actual practice, the pins 4 and 5 are independent from the rollers, wherefrom they can be detached by mere withdrawal, upon screwing out from the frame 1 or collar 10.

The first pin 4, or pin of the movable roller 2*a*, while being stationary rotatively, is displaceable inasmuch as it can be moved, against the pressure members 3, within the "V" notch 16, in any desired direction provided that it is included between the inclined surfaces 20.

As the sheets enter the nip between opposed rollers, the lugs 9, which are flexible, flex to allow for the sheets to pass therethrough, thus reducing the movement of the rollers away from each other, and without transmitting to the same any sharp impact force. Additionally to this, the alternating coated portions 7 and uncoated portions 8 tend to undulate and then slightly stretch the sheets, thus preventing a crimping thereof.

The invention achieves its objects. In fact, the rollers provided, thanks to the flexible lugs 9 protruding from the outer surfaces thereof, are forced to move away from each other as the sheets move past only to a limited extent. The lugs 9, in fact, accommodate by flexing the thickness and any uneveness in the sheets, even in the presence of a high pressure force between the rollers, as exerted by the pressure members 3. In actual practice, with the lugs 9, the rollers 2 are subjected to a reduced flexure strain, thereby they can be made hollow and quite thin walled. This has important consequences on the dynamic stability of the rollers, because owing to the reduced mass, the weight distribution irregularities are considerably attenuated, thereby also reducing the deviations generated in the rollers at high rotational speeds.

It is of importance to stress that the lugs 9 exert no elastic contact action, which as mentioned, would create hazardous elastic oscillations between the opposed rollers, but rather flex unelastically.

According to the invention, the oscillations and deviations of the rollers are effectively counteracted also by the novel support system. In fact, the ends of the rollers are not free in the axial direction, but rather held under axial strain, such as to oppose with auxiliary self-orientation forces any spontaneous hogging of the rollers. Contributing to the reduction of the uneven oscillations is also the ability conferred on the pins of the movable roller to move freely within the "V" notches 16. A sudden insertion of a thicker sheet between two opposed rollers is thus absorbed by the raising movement of the upper roller, which raising movement advantageously occurs in the same direction as imposed by the impact against the inserted sheet. Thus, no deviations and constraints are created that may be attributed to paths forcedly imposed on the movable rollers. The pneumatic cylinders 18 allow for these random movements within the "V" notch by virtue of the swivel connections 17. Moreover, the pneumatic cylinders 18 also ensure a constant pressure between the rollers as well as the ability of selecting such pressure.

It should be further noted that the invention teaches a specially practical and functional design of the rollers and their supports. In fact, thanks to the provision for a core 11 and sleeves 6 overlying it, any grinding operation of the roller outer surfaces is reduced to the grinding of sleeves of small size, and accordingly easier to machine, while replacement of any damages surface portions can be carried out by simply replacing one or more of the sleeves 6. Disassembly of one roller is also made extremely easy and quick without involving displacement of the frame 1 or the nearby rollers.

Further advantages achieved, as a result of the improvements according to this invention, are the following.

The rollers may also be arranged without some of the sleeves in order to provide free sliding areas when, for example, the passage of partly glue coated sheets is anticipated, or when free passage is to be provided for local raised portions.

Actual tests have further confirmed that calibration of the pressure force applied by the pneumatic cylinders 18, in a machine according to the invention teachings, may also be carried out coarsely, because it is no longer decisive for a proper operation of the machine.

Finally, the Applicant has determined that the perfect adhesion of the rollers to the sheets and absence of uneven entrainment forces, as due to local pressing or separation of the rollers resulting from the flexing thereof, has eliminated the formation of electrostatic charges on the sheets themselves, with consequent easier control and handling of the sheets throughout the machine.

The invention as described herein is susceptible to numerous modifications and variations, all of which fall within the instant inventive concept. For example, the shape of the lugs 9 may be selected at will, and the coating thereon may be a plastic material deposited by injection. Furthermore, all of the details may be replaced by other, technically equivalent, elements.

I claim:

1. A machine for folding sheet material, comprising a stationary frame, at least one pair of rollers rotatably supported by said stationary frame and arranged parallel to each other, pressure members for biasing said rollers toward each other, a plurality of sleeves on said each rollers each having a coated portion of substantially hard and unelastic rubber-like material; each of said coated portions having a circumferential surface having a plurality of flexible bosses thereon, said coated portions being arranged axially spaced from one another on said rollers to define uncoated portions therebetween, wherein said coated portions and said uncoated portions have equal axial lengths and said flexible bosses have outer ends projecting radially above said uncoated portions, and wherein said coated portions of one of said rollers are axially offset with respect to said coated portions of the other of said rollers such that each of said coated portions on one of said rollers exactly faces a corresponding one of said uncoated portions on the other of said rollers.

2. A machine as claimed in claim 1, wherein each of said sleeves comprises one of said coated portions and one of said uncoated portions, said sleeves being arranged adjacent each other in mutual engagement.

3. A machine as claimed in claim 2, wherein said uncoated portions of said sleeves are knurled.

4. A machine as claimed in claim 1, further comprising stationary support pins for said rollers, said pins rotatably supporting said rollers by interposition of thrust bearings and means arranged within said stationary frame to axially compress said rollers at their ends.

* * * * *